US011123775B2

(12) United States Patent
Chen

(10) Patent No.: US 11,123,775 B2
(45) Date of Patent: Sep. 21, 2021

(54) APPARATUS AND METHOD FOR CLEANING SUBSTRATES

(71) Applicant: STEK CO., LTD, Taichung (TW)

(72) Inventor: Ming-Sheng Chen, Taichung (TW)

(73) Assignee: STEK CO., LTD, Taichung (TW)

( * ) Notice: Subject to any disclaimer, the term of this patent is extended or adjusted under 35 U.S.C. 154(b) by 0 days.

(21) Appl. No.: 15/967,577

(22) Filed: Apr. 30, 2018

(65) Prior Publication Data

US 2019/0329301 A1 Oct. 31, 2019

(51) Int. Cl.

| | |
|---|---|
| ***B08B 7/04*** | (2006.01) |
| ***B08B 1/00*** | (2006.01) |
| ***B08B 3/04*** | (2006.01) |
| ***B08B 3/10*** | (2006.01) |

(52) U.S. Cl.

CPC ..... *B08B 7/04* (2013.01); *B08B 1/006* (2013.01); *B08B 3/04* (2013.01); *B08B 3/041* (2013.01); *B08B 3/10* (2013.01)

(58) Field of Classification Search

CPC .. B08B 7/04; B08B 1/006; B08B 3/04; B08B 3/041; B08B 3/10

USPC ..... 134/184

See application file for complete search history.

(56) References Cited

U.S. PATENT DOCUMENTS 4,973,496 A * 11/1990 Kruger ..... G11B 5/84 427/127

FOREIGN PATENT DOCUMENTS

JP 2012250300 A * 12/2012

OTHER PUBLICATIONS

JP2012250300A—machine translation (Year: 2012).*

* cited by examiner

*Primary Examiner* — Tinsae B Ayalew

(57) ABSTRACT

A substrate-cleaning apparatus includes a transmission unit, a wet cleaning unit and a dry cleaning unit. The transmission unit includes a movable clamp for clamping a substrate that includes a face without covering the face of the substrate. The wet cleaning unit includes a wiper and a liquid pump. The wiper includes a strip of cleaning cloth and an abutting element for pressing the cleaning cloth against the face of the substrate. The liquid pump sends cleaning liquid to the abutting element that in turn sends the cleaning liquid to the cleaning cloth when the abutting element presses the cleaning cloth against the face of the substrate. The dry cleaning unit includes a wiper comprising a strip of cleaning cloth for wiping dry the face of the substrate without leaving any water mark on the face.

5 Claims, 9 Drawing Sheets

APPARATUS AND METHOD FOR CLEANING SUBSTRATES

BACKGROUND OF INVENTION

1. Field of Invention

The present invention relates to substrates of masks used in lithography and, more particularly, to an apparatus and method for cleaning substrates of masks used in lithography.

2. Related Prior Art

Referring to FIG. 1, a mask 100 used in lithography includes a substrate 110, a frame 120 and a pellicle 150. There is inevitably contamination such as particles and stains of chemical substances on the mask 100 and, more particularly, on the substrate 110 or the pellicle 150. A contaminant on the mask 100 causes a defect on a wafer made in the lithography. Conventionally, the substrate 110 is washed with a large amount of cleaning liquid. However, a worker could feel uncomfortable when exposed to such large amount of cleaning liquid. Moreover, water marks could be left on the substrate 110 after such cleaning liquid is dried. Hence, the effectiveness of the cleaning of the substrate 110 is jeopardized, and so is the cleanness of the substrate 110.

As discussed above, there are problems with the cleaning of the substrate 110. The present invention is intended to obviate or at least alleviate the problems encountered in prior art.

SUMMARY OF INVENTION

It is the primary objective of the present invention to provide an apparatus and method for effectively cleaning a substrate.

It is another objective of the present invention to provide an apparatus and method for effectively cleaning a substrate without leaving any water mark on the substrate.

To achieve the foregoing objectives, the substrate-cleaning apparatus includes a transmission unit, a wet cleaning unit and a dry cleaning unit. The transmission unit includes a movable clamp for clamping a substrate that includes a face without covering the face of the substrate. The wet cleaning unit includes a wiper and a liquid pump. The wiper includes a strip of cleaning cloth and an abutting element for pressing the cleaning cloth against the face of the substrate. The liquid pump sends cleaning liquid to the abutting element that in turn sends the cleaning liquid to the cleaning cloth when the abutting element presses the cleaning cloth against the face of the substrate. The dry cleaning unit includes a wiper comprising a strip of cleaning cloth for wiping dry the face of the substrate without leaving any water mark on the face.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
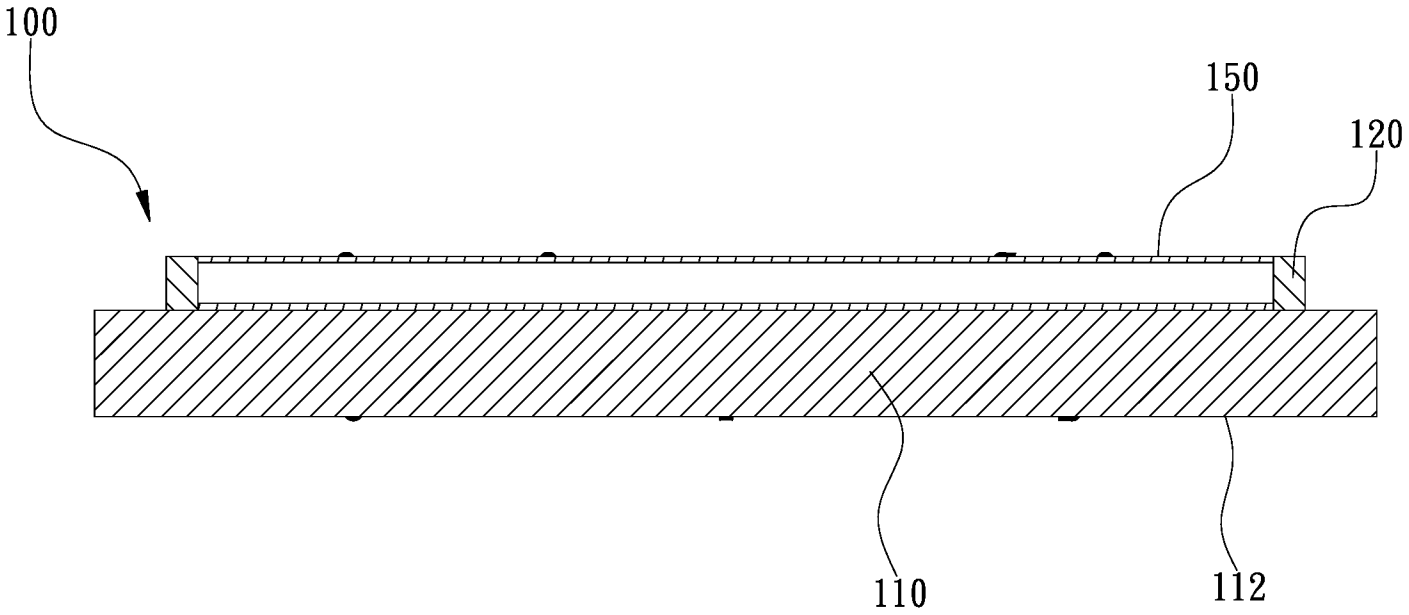
FIG. 1 is a cross-sectional view of a typical mask for use in lithography.
Figure 2:
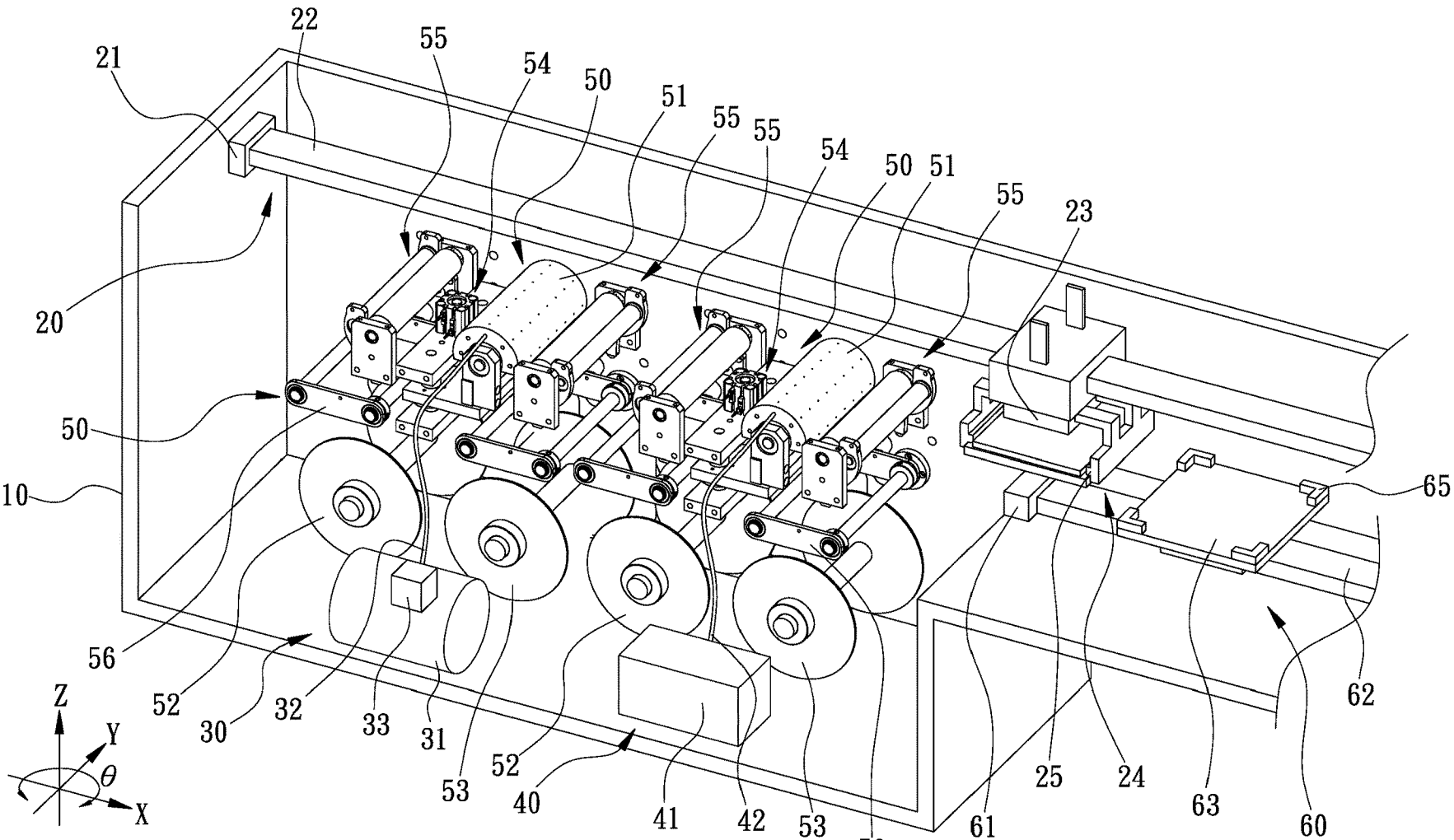
FIG. 2 is a perspective view of a substrate-cleaning apparatus according to the preferred embodiment of the present invention.
Figure 3:
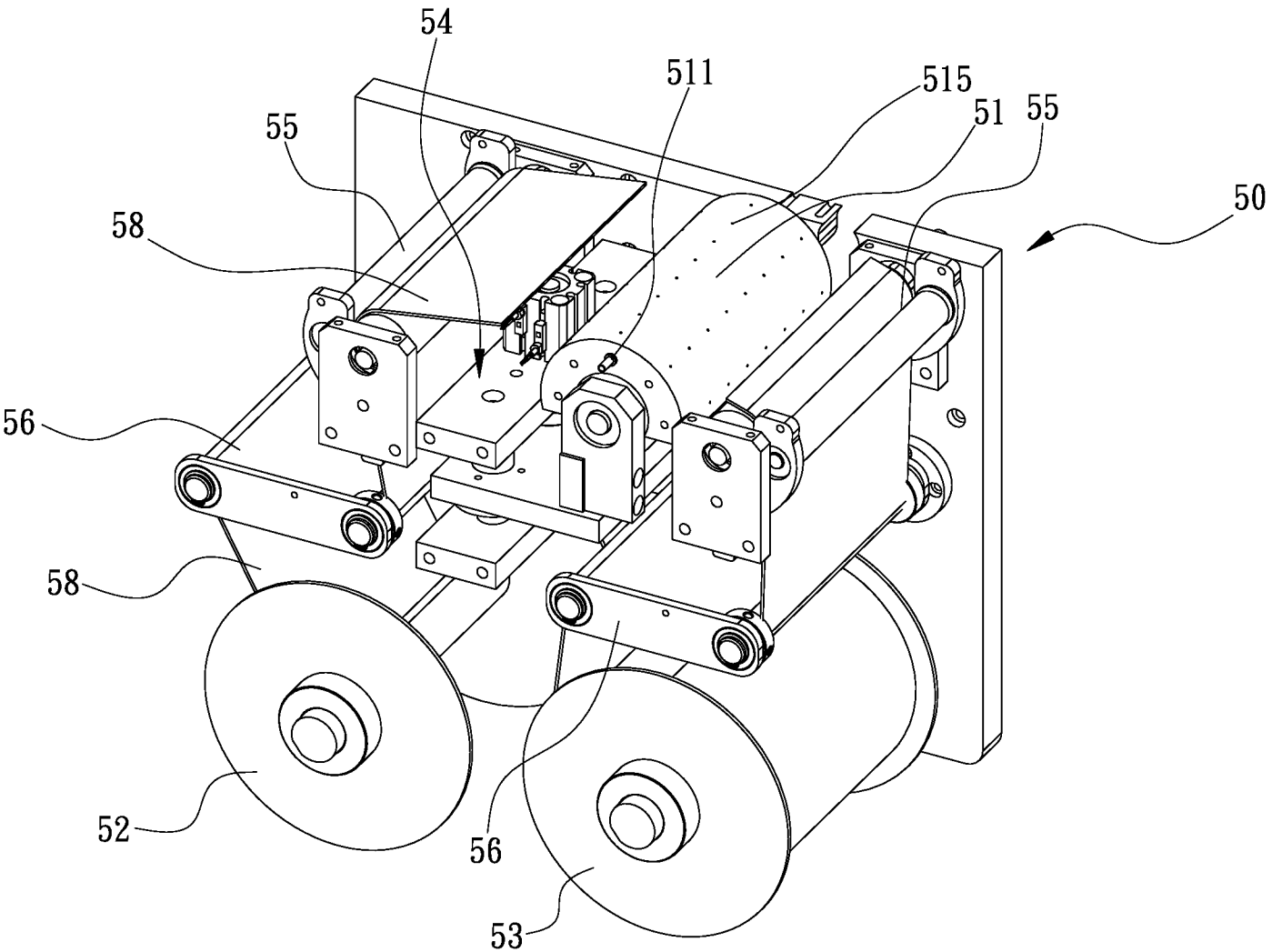
FIG. 3 is an enlarged perspective view of a wiper used in the substrate-cleaning apparatus shown in FIG. 2.

Referring to FIG. 1, a mask 100 used in lithography includes a substrate 110, a frame 120 and a pellicle 150. Referring to FIGS. 2 to 5, there is a substrate-cleaning apparatus according to the preferred embodiment of the present invention. The substrate-cleaning apparatus is operable to clean a face 112 of the substrate 110. The substrate-cleaning apparatus includes a frame 10, a transmission unit 20, a wet cleaning unit 30 and a dry cleaning unit 40.

The transmission unit 20 is supported on the frame 10 for moving the substrate 110. The transmission unit 20 includes a driver 21, a track 22, an elevator 23 and a clamp 24. The driver 21 is operable to move the elevator 23 along the track 22 in a direction X. The elevator 23 is operable to move the clamp 24 in a direction Z. The clamp 24 includes at least two claws 25 operable to grasp the substrate 110 by opposite edges or corners. Thus, the substrate 110 is movable in the directions X and Y.

The wet cleaning unit 30 is supported on the frame 10 and includes a liquid pump 31, a liquid tube 32 and a wiper 50. Preferably, the liquid pump 31 includes a nanobubble producer 33 operable to produce nanobubbles to improve the effect of cleaning. Preferably, the wet cleaning unit 30 further includes a liquid collector 35.

The wiper 50 is supported on the frame 10 and includes an abutting element 51, a feeder roller 52, a collector roller 53, an elevator 54, two pressers 55, and two tension rollers 56. A strip of cleaning cloth 58 includes a section wound on the feeder roller 52 and another section wound on the collector roller 53. In operation, the cleaning cloth 58 is in contact with and moved past the abutting element 51, the pressers 55 and the tension rollers 56.

Figure 4:
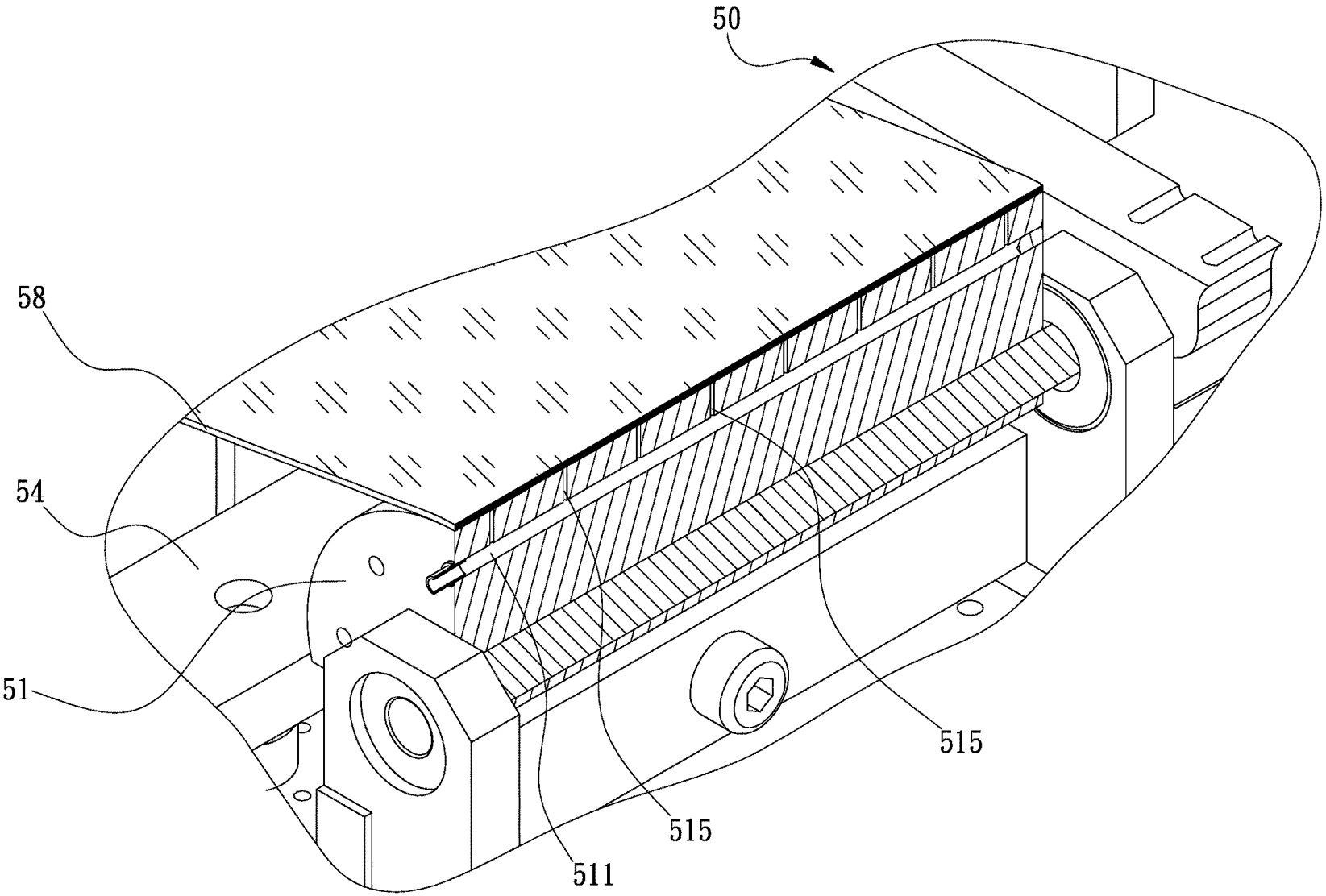
FIG. 4 is an enlarged cut-away view of an abutting element used in the wiper shown in FIG. 3.

The abutting element 51 includes channels 511 connected to the liquid pump 31 through the liquid tube 32 (FIG. 4). Thus, cleaning liquid can be transmitted to the channels 511 from the liquid pump 31 via the liquid tube 32. Each of the channels 511 is in communication with a group of orifices 515 in the periphery of the abutting element 51. Thus, the cleaning liquid can be sent to the cleaning cloth 58 from the tunnels 511 via the groups of orifices 515 when the cleaning cloth 58 is in contact with the abutting element 51.

One of the pressers 55 (the "leading presser 55") is located between the feeder roller 52 and the abutting element 51 along the path of the cleaning cloth 58. The remaining presser 55 (the "trailing presser 55") is located between the abutting element 51 and the collector roller 53. Each of the leading and trailing pressers 55 includes two rollers in contact with two opposite sides of the cleaning cloth 58. Thus, the leading and trailing pressers 55 keep the cleaning cloth 58 flat, thereby ensuring that the cleaning cloth 58 is smoothly moved past the abutting element 51.

One of the tension rollers 56 (the "leading tension roller 56") is located between the feeder roller 52 and the leading presser 55 along the path of the cleaning cloth 58. The remaining tension roller 56 (the "trailing tension roller 56") is located between the trailing presser 55 and the collector roller 53. The tension rollers 56 are also used to retain the cleaning cloth 58 properly tight.

Figure 5:
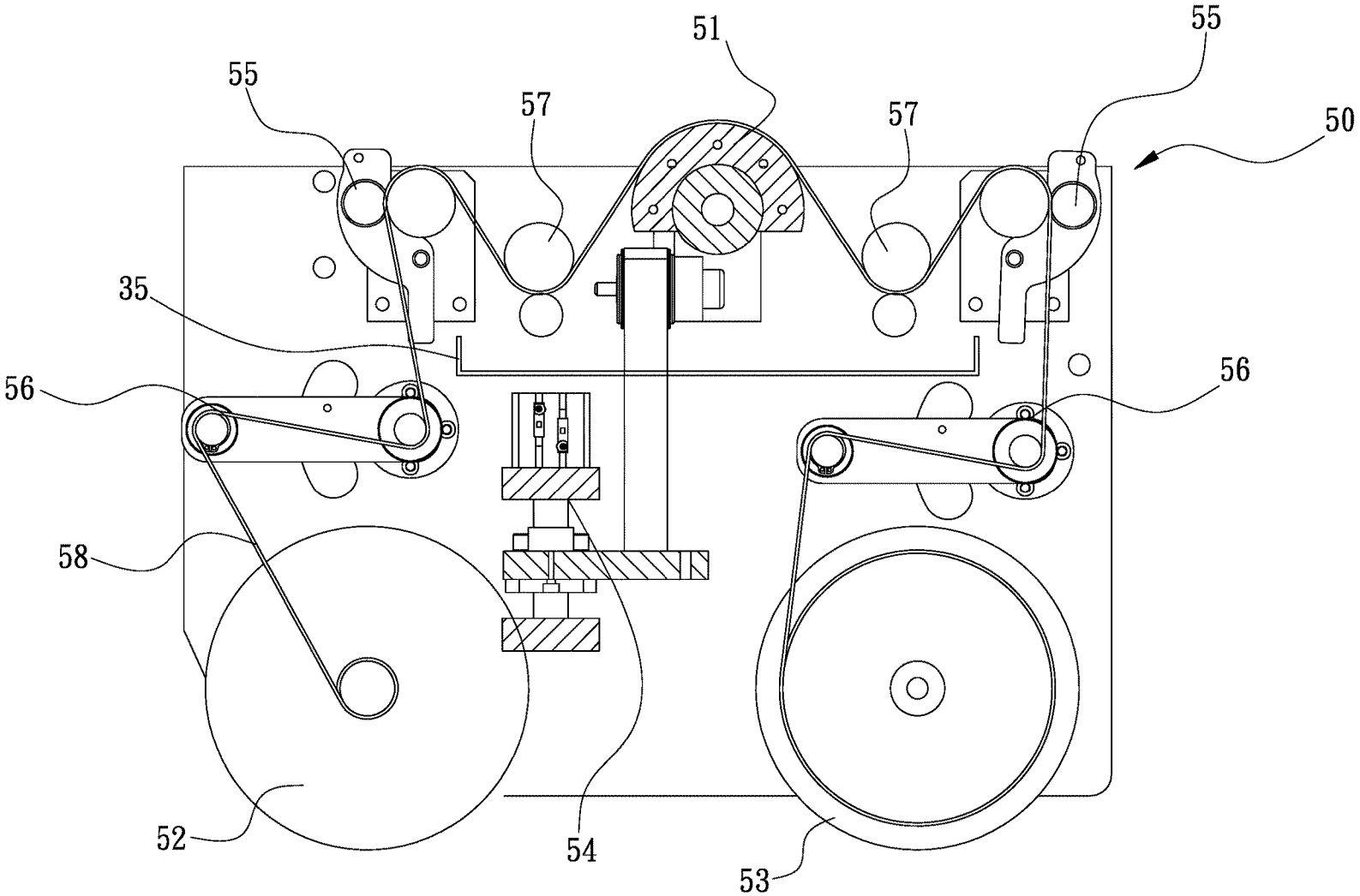
FIG. 5 is a front view of the wiper shown in FIG. 3.

Referring to FIG. 5, the wiper 50 further includes two squeezers 57. One of the squeezers 57 (the "leading squeezer 57") is located between the leading presser 55 and the abutting element 51. The remaining squeezer 57 (the "trailing squeezer 57") is located between the abutting element 51 and the trailing presser 55. Each of the leading and trailing squeezers 57 includes two rollers between in contact with the opposite sides of the cleaning cloth 58 so that the cleaning cloth 58 is pinched and squeezed when the cleaning cloth 58 is moved through each of the squeezers 57. The leading and trailing squeezers 57 are located lower than the abutting element 51 and the pressers 55 so that the cleaning liquid can be squeezed out of the cleaning cloth 58 with the leading and trailing squeezers 57 and that the cleaning liquid cannot be sent to the pressers 55. The liquid collector 35 is located below the abutting element 51 and the leading and trailing squeezers 57 so that an excessive amount of cleaning liquid drops into the liquid collector 35 from the leading and trailing squeezers 57.

The dry cleaning unit 40 includes another wiper 50 identical to the one used in the wet cleaning unit 30. The dry cleaning unit 40 further includes an air supply 41 and an air pipe 42. The channels 511 of the abutting element 51 of the wiper 50 of the dry cleaning unit 40 is connected to the air supply 41 through the air pipe 42 so that air can be sent to the channels 511 of the abutting element 51 of the wiper 50 of the dry cleaning unit 40 from the air supply 41 via the air pipe 42. Then, the air leaves the abutting element 51 of the wiper 50 of the dry cleaning unit 40 from the orifices 515 and dries the cleaning cloth 58.

Furthermore, the substrate-cleaning apparatus includes a substrate-moving unit 60 supported on the frame 10 at an end of the transmission unit 20. The substrate-moving unit 60 includes a driver 61, a track 62 and a carrier 63. The carrier 63 is movable along the track 62 in the direction X. The carrier 63 is rotatable about an axis in parallel to the direction Z for an angle θ. In operation, the mask 100, which includes the substrate 110, is located on the carrier 63. The carrier 63 is movable in the direction X and rotatable about the axis in parallel to the direction Z so that the mask 100 can be clamped by the clamp 24 of the transmission unit 20. The carrier 63 includes claws 65 for clamping the mask 100.

An optical inspection apparatus (not shown) can be located at another end of the substrate-moving unit 60. The mask 100 can be sent to the substrate-cleaning apparatus to be cleaned if the optical inspection apparatus detects any contaminant on the face 112 of the substrate 110. After the washing, the mask 100 can be sent to the substrate-cleaning apparatus again to determine whether if the face 112 of the substrate 110 has been properly cleaned.

Figure 6:
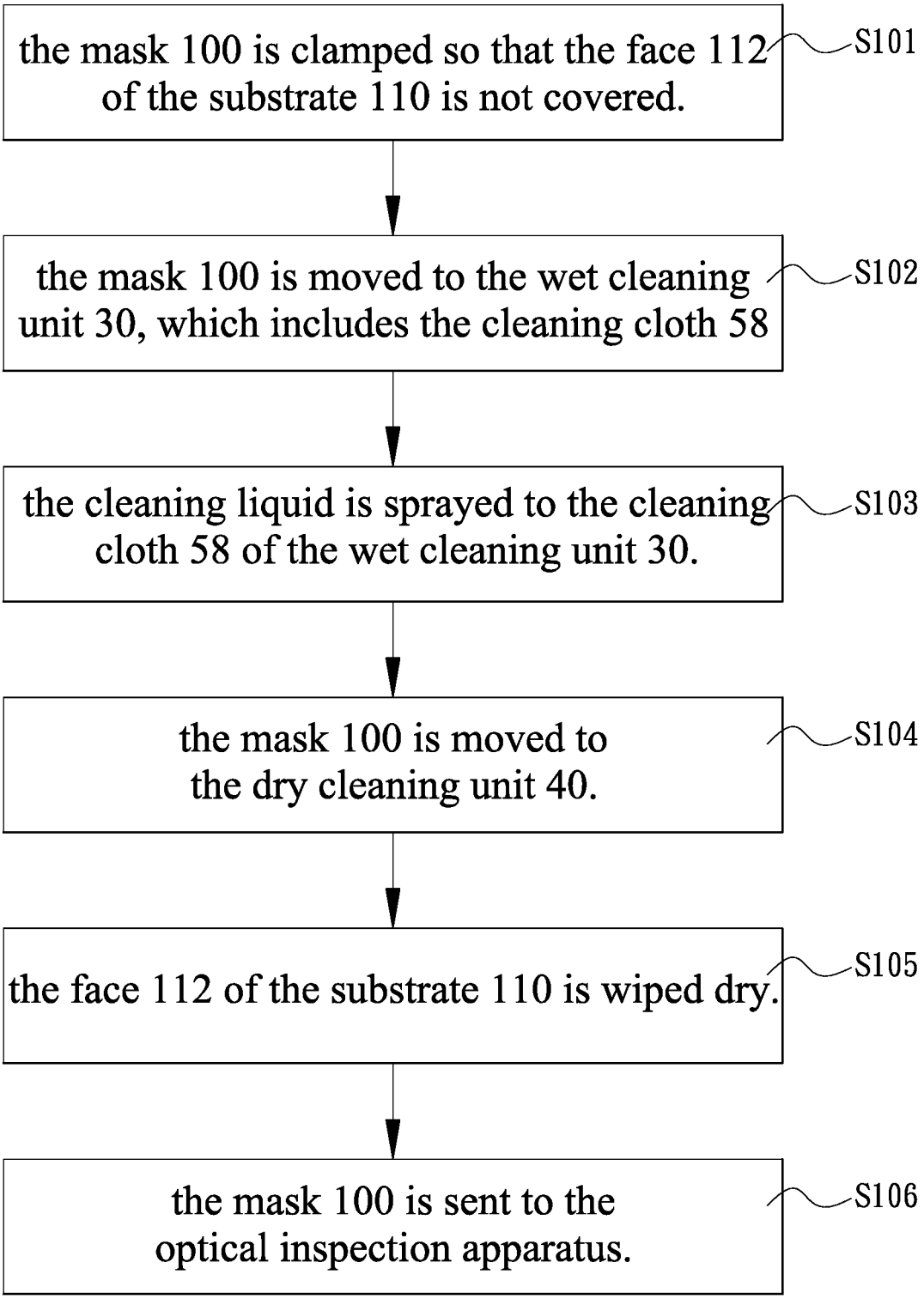
FIG. 6 is a flow chart of a substrate-cleaning method executed in the substrate-cleaning apparatus shown in FIG. 2.
Figure 7:
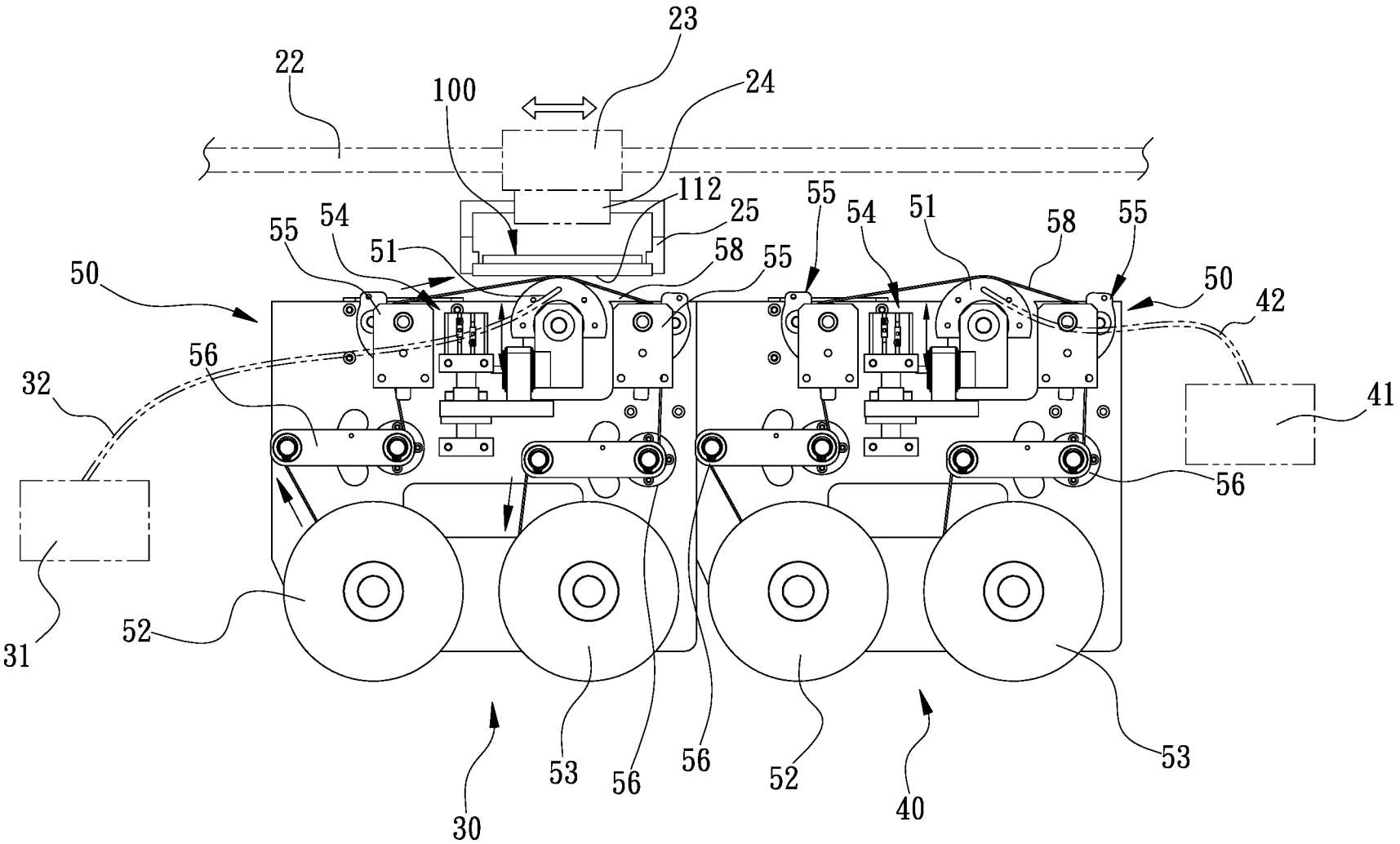
FIG. 7 is a front view of the substrate-cleaning apparatus depicted in FIG. 2.
Figure 8:
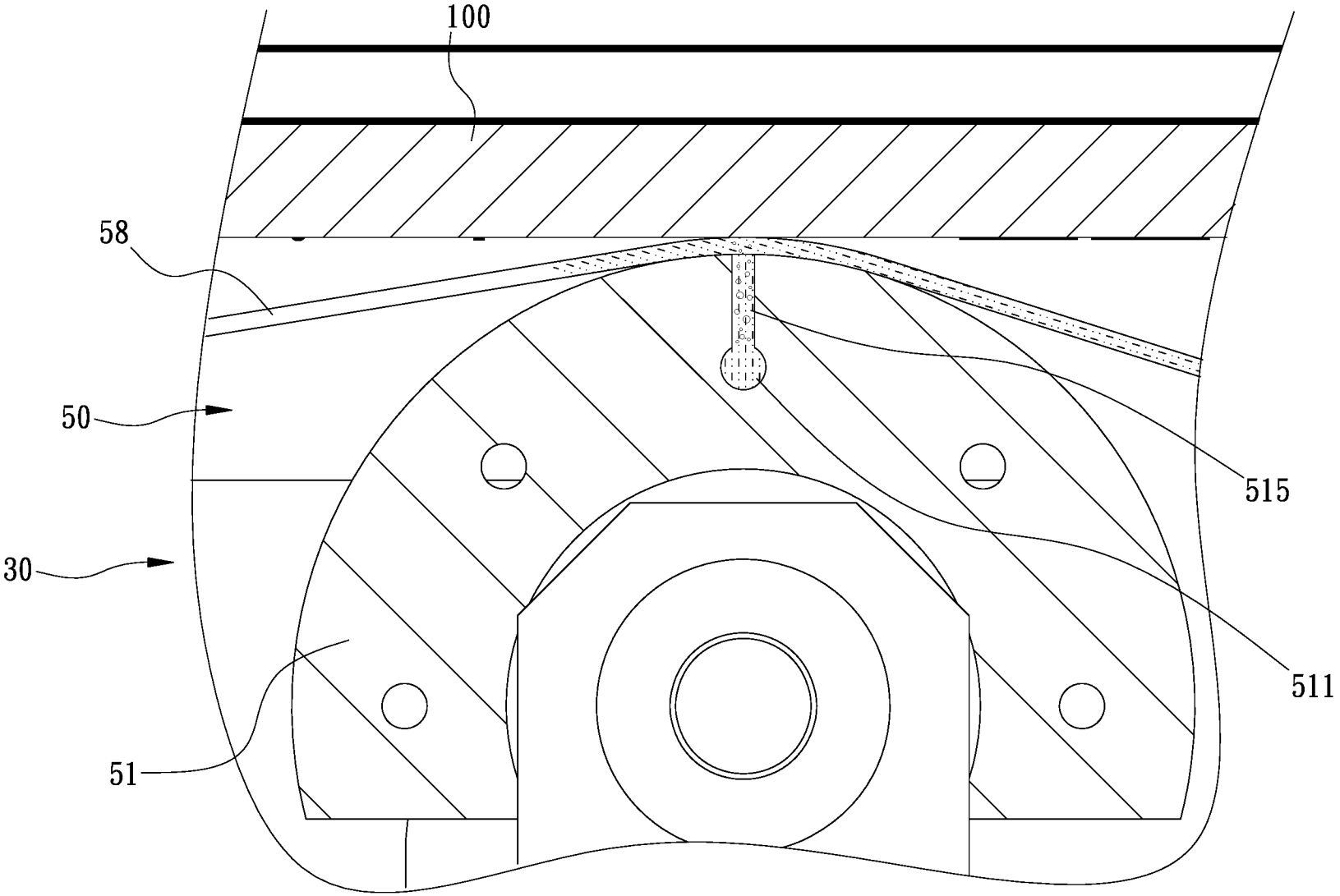
FIG. 8 is another enlarged cut-away view of the abutting element shown in FIG. 3.
Figure 9:
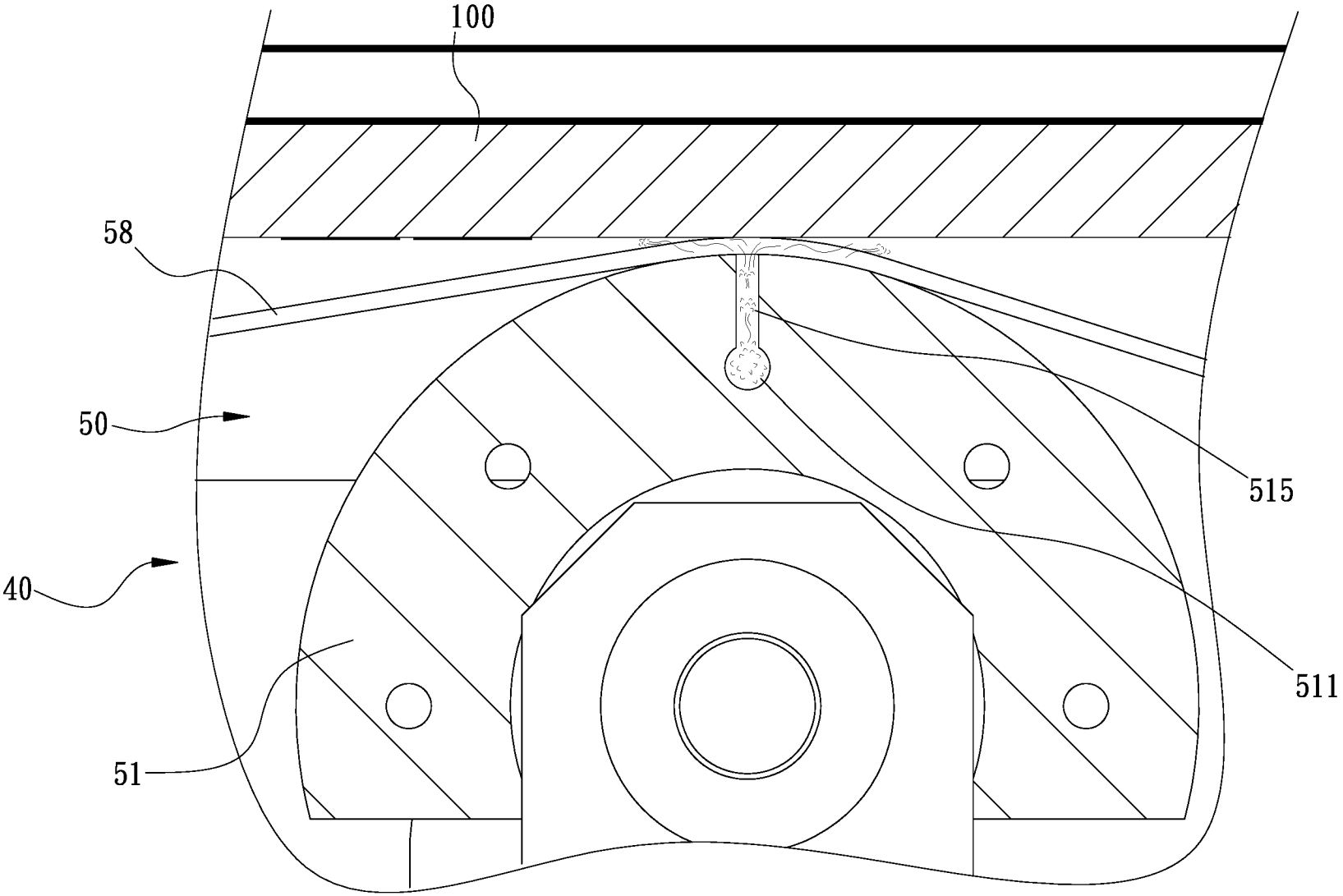
FIG. 9 is enlarged cut-away view of the abutting element in another position than shown in FIG. 8.

Referring to FIG. 6, there is a substrate-cleaning method executed in the substrate-cleaning apparatus. Referring to FIGS. 7 to 9, the substrate-cleaning apparatus at several steps of the substrate-cleaning method is shown.

At S101, the mask 100 is clamped so that the face 112 of the substrate 110 is not covered. The clamp 24 of the transmission unit 20 is operable to clamp the mask 100 without covering the face 112 of the substrate 110. Thus, the face 112 of the substrate 110 can be cleaned without any interference.

At S102, the mask 100 is moved to the wet cleaning unit 30, which includes the cleaning cloth 58. Referring to FIG. 7, the clamp 24 of the transmission unit 20 is operable to move the mask 100 to the wet cleaning unit 30 in the directions X and Z.

At S103, the cleaning liquid is sprayed to the cleaning cloth 58 of the wet cleaning unit 30. Referring to FIGS. 7 and 8, the elevator 54 of the wiper 50 of the wet cleaning unit 30 is used to move the abutting element 51 in the direction Z, thereby pressing the cleaning cloth 58 against the face 112 of the substrate 110. Synchronously, the liquid pump 31 of the wet cleaning unit 30 sends the cleaning liquid upward to the cleaning cloth 58 via the liquid tube 32 and the channels 511 and the orifices 515 of the abutting element 51. Then, the clamp 24 is used to move the mask 100 in the direction X so that the face 112 of the substrate 110 can be wetted and wiped. Moreover, the liquid pump 31 can be used to produce nanobubbles to help remove contaminants from the face 112 of the substrate 110, thereby improving the effect of the cleaning.

At S104, the mask 100 is moved to the dry cleaning unit 40. Referring to FIG. 7, the clamp 24 of the transmission unit 20 is operable to move the mask 100 to a position above the dry cleaning unit 40 in the directions X and Z.

At S105, the face 112 of the substrate 110 is wiped dry. The cleaning cloth 58 of the dry cleaning unit 40 is used to wipe the face 112 of the substrate 110, thereby drying the face 112 of the substrate 110, without leaving any water mark. Referring to FIGS. 7 and 9, the elevator 54 of the wiper 50 of the dry cleaning unit 40 is used to the abutting element 51 in the direction Z, thereby pressing the cleaning cloth 58 against the face 112 of the substrate 110. Then, the clamp 24 is used to move the mask 100 in the direction X so that the face 112 of the substrate 110 is wiped. In addition, the dry cleaning unit 40 is used to send air to the cleaning cloth 58 from the air supply 41 via the air pipe 42 and the channels 511 and the orifices 515 of the abutting element 51 of the dry cleaning unit 40. The air helps dry the face 112 of the substrate 110.

At S106, the mask 100 is sent to the optical inspection apparatus. After the washing in the wet cleaning unit 30 and the drying in the dry cleaning unit 40, the clamp 24 of the transmission unit 20 is used to move the mask 100 back to the carrier 63 of the substrate-moving unit 60. Then, the mask 100 can be moved to the optical inspection apparatus from the substrate-cleaning apparatus.

The above-mentioned process can be repeated for several times if the contamination of the face 112 of the substrate 110 is severe.

Advantageously, the clamp 24 of the transmission unit 20 is used to grasp and move the mask 100 to the wet cleaning unit 30 to be washed and to the dry cleaning unit 40 to be dried. The washing of the face 112 of the substrate 110 is effective for using the cleaning cloth 58 of the wet cleaning unit 30 provided with the cleaning liquid. The washing of the face 112 of the substrate 110 is inexpensive and save because the amount of the cleaning liquid used is small. This small amount of cleaning liquid is made possible since the cleaning liquid is sprayed to the liquid cloth 58 of the wet cleaning unit 30, not poured to the face 112 of the substrate 110. The drying of the face 112 of the substrate 110 is effective without leaving any water mark due to the use of the cleaning cloth 58 of the dry cleaning unit 40 used with the air.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A substrate-cleaning apparatus comprising:

a transmission unit comprising a movable clamp for clamping a substrate that comprises a face, without covering the face of the substrate;

a wet cleaning unit comprising:

a wiper comprising a strip of cleaning cloth and an abutting element for pressing the cleaning cloth against the face of the substrate;

a liquid pump for sending cleaning liquid to the abutting element that transfers the cleaning liquid to the cleaning cloth when the abutting element presses the cleaning cloth against the face of the substrate; and a nanobubble producer located in the liquid pump and operable to produce nanobubbles; and a dry cleaning unit comprising:

a wiper comprising a strip of cleaning cloth for wiping dry the face of the substrate without leaving any water mark on the face; and an air supply for sending air to the abutting element of the dry cleaning unit so that the abutting element of the dry cleaning unit in turn sends the air to the cleaning cloth.

2. The substrate-cleaning apparatus according to claim 1, wherein the abutting element of the wiper the dry cleaning unit comprises at least one channel in communication with the air supply pump via an air pipe and at least one group of orifices in communication with the at least one channel thereof and in a periphery of the abutting element thereof.

3. The substrate-cleaning apparatus according to claim 1, wherein the abutting element of the wiper of the wet cleaning unit comprises at least one channel in communication with the liquid pump via a liquid tube and at least one group of orifices in communication with the at least one channel thereof and in a periphery thereof.

4. The substrate-cleaning apparatus according to claim 1, wherein the wiper of each of the wet and dry cleaning units comprises:

a feeder roller located on a side of the abutting element;

a collector roller located on an opposite side of the abutting element;

a leading presser located between the feeder roller and the abutting element;

a trailing presser located between the abutting element and the collector roller;

a leading tension roller located between the feeder roller and the leading presser; and a trailing tension roller located between the trailing presser and the collector roller.

5. The substrate-cleaning apparatus according to claim 4, wherein the wiper of the wet cleaning unit further comprises:

a leading squeezer located between the leading presser and the abutting element, wherein an excessive amount of the cleaning liquid is squeezed from the cleaning cloth when the cleaning cloth is moved through the leading squeezer; and a trailing squeezer located between the abutting element and the trailing presser, wherein another excessive amount of the cleaning liquid is squeezed from the cleaning cloth when the cleaning cloth is moved through the trailing squeezer;

wherein the leading and trailing squeezers are located below the abutting element and the presser, thereby keeping the excessive amounts of the cleaning liquid from the abutting element and the pressers.

* * * * *